US006032889A

United States Patent [19]

Thrasher

[11] Patent Number: 6,032,889

[45] Date of Patent: Mar. 7, 2000

[54] ROCK CRUSHER (BALANCE AND PINS)

[76] Inventor: Allen R. Thrasher, Rte. 2 Box 48, Floydada, Tex. 79235

[21] Appl. No.: 09/190,036

[22] Filed: Nov. 11, 1998

Related U.S. Application Data

[63] Continuation-in-part of application No. 08/731,091, Oct. 9, 1996, Pat. No. 5,863,006.

[51] Int. Cl.[7] ..... B02C 19/00

[52] U.S. Cl. ..... 241/275

[58] Field of Search ..... 241/275, 5, 285.1

[56] References Cited

U.S. PATENT DOCUMENTS 4,390,136 6/1983 Burk ..... 241/275

5,863,006 1/1999 Thrasher ..... 241/275

*Primary Examiner*—Mark Rosenbaum

*Attorney, Agent, or Firm*—Wendell Coffee; Mark Scott

[57] ABSTRACT

A rotor of a vertical shaft rock crusher is balanced by steel balls in a circular tube attached to the rotor. Ports in the rotor are protected by tungsten carbide pins encased in iron pipes at the top, bottom, and trailing lips of the ports. The pins at the top and bottom of the ports are welded to a mounting plate which is clamped in the rotor over each port. The lip pin at the trailing lip, which has a shorter life than the other pins, is held in a seat in the rotor by the mounting plate. Therefore, the lip pin may be individually replaced. A safety pin welded to the mounting plate is next to the lip pin to protect the rotor between the time the lip pin fails and is replaced.

15 Claims, 5 Drawing Sheets

ROCK CRUSHER (BALANCE AND PINS)

CROSS REFERENCE TO RELATED APPLICATION

This is a Continuation-in-Part of the previous application by Allen R. Thrasher, which was filed on the 9th day of October 1996, Ser. No. 08/731,091, now U.S. Pat. No. 5,863,006 issued on Jan. 26, 1999.

BACKGROUND OF THE INVENTION:

(1) Field of the Invention

This invention is related to vertical shaft impact rock crushers. Rock crusher operators have ordinary skill in this art.

(2) Description of the Related Art

Impact rock crushers have been known for over thirty years. See Miller U.S. Pat. No. 3,174,698 and Bridgewater U.S. Pat. No. 3,174,697. However before this invention the crushers had two major problems. The first was vibration. By adding a large mass of rocks to be crushed the rocks would flow into a impeller rotating at high speed in uneven amounts. With the changing flow of the rocks within the impeller the impeller would almost always be imbalanced and vibrate accordingly.

Another problem was the abrasion. The rocks moved over metal parts within the rotors or impellers and their movement would quickly abrade the parts. Also, larger rocks impacting the impellers required them to be of rather heavy material.

The abrasion problem was at least in part alleviated by forming rock packs or packed material in pockets to provide the surface that the rocks abraded. Such structure is shown for example in the U.S. patents of Bridgewater 3,174,697, Canada 5,145,118, Bartley 4,921,173, Terrenzio 4,513,919, Szalanski 4,560,113 and Watajima 4,844,354. The Sazlanski rock pack of FIG. 5 is of particular interest.

The maintenance costs of a rock crusher is a considerable amount. Before invention, the annual maintenance costs of the rock crusher could be as high as the 21% of the value of the rock crushed.

The percentage of the costs for the maintenance has been calculated of a specific crusher on the basis that spare parts cost $180. per hour of use. The rock crusher crushes about 300 Tons of rocks per hour. The selling price of crushed rock would be about $6. per ton. It is estimated the labor costs for installation of the spare parts would be equal to the cost of the spare parts. In addition, inspection costs of (at $18.00/Hr.) of 0.5 Hr. for every 5 hours of operation is necessary. Therefore the costs of maintenance would be $361.80 per hour. The selling price of the 300 Ton crushed rock per hour would be $1800.00.

It is has been known for over a hundred years that a fluid or fluid-like material could be placed within the rings on spinning structure such as the Withee U.S. Pat. No. 229,787. However, generally these have been used only upon structures which do not have the magnitude of unbalance such as the rotors of rock crushers. For example, Withee was concerned with balancing a millstone which would have basically been symmetrical in any event. He suggested that the fluid-like material could be shot, sand or water.

SUMMARY OF THE INVENTION:

(1) Progressive Contribution to the Art

This application discloses solutions to the problems in the prior art. First, a hollow ring is placed upon the top of the rotor along the sidewall of the rotor. It is circular and filled with about sixty pounds of steel balls with oil. As is known the spherical balls will act as a fluid and will move to balance the rotor. As the rocks within the rotor change the center of gravity, the fluid (balls) within the ring will move to restore balance.

To reduce abrasion, a free-floating table is placed in the rotor over the bottom of the rotor. When the rocks are fed into the rotor the table will not be revolving as fast as the rotor. Therefore the rocks will not be slung from the table with the same force as if the table turned at the same speed as the rotor. This also will permit an ample rock pile to build on the table.

Although the free-wheeling plate is designed to have less abrasion some will be present. Therefore the tungsten carbide disc will be placed upon the top of the table, protecting the entire top of the table.

Vanes are arranged having a pocket formed on the leading face of the vanes. This will form a rock pack with a rock face or surface which entirely covers the leading face of the vanes and therefore prevents abrasion to the leading face.

Also, this will prohibit the vanes from being battered by high-speed rocks. The rocks will come off the free-floating table without a great rotational velocity. Therefore they will impact upon the rock surface on the leading face of the vanes and will not contact the trailing face of the vane. The trailing face of the vane will form an obtuse angle to a radial line. However because of the higher speed of the rotation of the rotor and rock face the rocks will be struck by the rock surface formed against the leading face of the vane. The rocks will abrade rock against rock to the ports.

The trailing face of the ports are protected by a tungsten carbide pin. The rock packs and rock surfaces will form above the top surface of the port and below the bottom surface of the port and there will be rocks sliding across these lips. Therefore these lips are also protected by tungsten carbide pins. The tungsten carbide pins are mounted within steel tubes to give back support to the pins. Within a few minutes of installation the face of the steel tube will be abraded away by the rocks traveling over the pin. However, the back side will not be abraded away and will support the brittle tungsten carbide.

Although the pins have been designed for reduced breakage and there will be a certain amount of abrasion and the tungsten carbide pins will require replacement periodically.

To permit easier replacement, the pins are mounted upon a steel door or plate which is attached to the inside of the rotor over the ports. The mounting plates will have an opening within them at the same place as the ports. The steel tubes will be welded to the steel plates. Also, the tungsten carbide pin at the trailing lip will be placed in a pocket formed in the rotor housing to support the steel tube which in turn supports the pin.

(2) Objects of this Invention

An object of this invention is to reduce the cost of crushing rocks by reducing the maintenance of rock crushers by reducing the abrasion and vibration damage to the rock crusher.

Thus an object of this invention is to provide a balancer for balancing rotating parts of a vertical shaft impact rock crusher.

Further an object of this invention is to form better rock packs and rock surfaces to protect the parts of rock crushers.

Still further objects of this invention is to provide better support for tungsten carbide pins and abrasion areas of a rock crusher.

Still further objects are to control the paths of rocks within a rock crusher to prevent their high speed movement of the rock impacting any surface other than a rock pack.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

Figure 1:
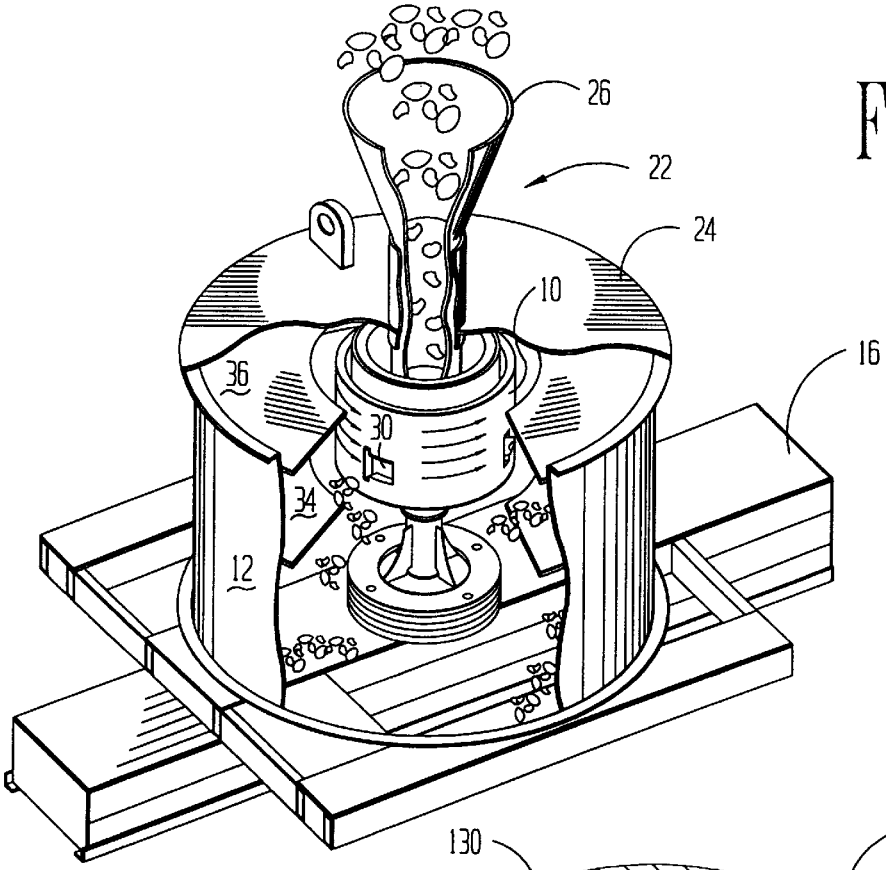
FIG. 1 is a perspective view of an embodiment of this invention with parts broken away to show details of construction.

CATALOGUE OF ELEMENTS
As an aid to correlating the terms of the claims to the exemplary drawing(s), the following catalog of elements and steps is provided

| | |
|---|---|
| 10 | rotor |
| 12 | container |
| 14 | vertical shaft |
| 16 | framework |
| 17 | bearings |
| 18 | motors |
| 20 | belt drive |
| 22 | feeder |
| 24 | top, container |
| 26 | funnel |
| 28 | tube or chute |
| 30 | ports |
| 32 | anvil, pack of rocks |
| 34 | lower shelf |
| 36 | top shelf |
| 38 | balancer base plate |
| 40 | rotor top |

-continued

CATALOGUE OF ELEMENTS
As an aid to correlating the terms of the claims to the exemplary drawing(s), the following catalog of elements and steps is provided

| | |
|---|---|
| 42 | tore, ring |
| 44 | ring top |
| 46 | opening |
| 48 | plug |
| 50 | steelballs |
| 52 | oil |
| 54 | cylindrical wall |
| 56 | protection plate |
| 58 | vanes |
| 60 | rotor bottom disc |
| 62 | inner edge |
| 64 | bolt |
| 66 | nut |
| 68 | leading face |
| 70 | trailing face |
| 72 | dashed line |
| 74 | rock shield |
| 76 | trailing lip |
| 78 | leading lip |
| 80 | rock face |
| 82 | bottom lip |
| 84 | top lip |
| 86 | axial bore |
| 88 | table pin |
| 90 | table disc |
| 92 | bearing |
| 93 | lugs |
| 94 | tungsten carbide disc |
| 96 | steel ring |
| 100 | lip pin |
| 102 | steel pipe |
| 103 | 6" opening |
| 104 | door |
| 106 | outside face |
| 108 | slot |
| 110 | seat |
| 112 | pattern plate |
| 114 | brass pin |
| 116 | weld metai |
| 118 | horizontal carbide pins |
| 120 | pipe |
| 122 | inside face |
| 124 | bolts |
| 126 | top flange |
| 128 | clips |
| 130 | nut |
| 132 | safety pin |
| 134 | safety pin pipe |
| 136 | holding blocks |
| 138 | |
| 140 | |

DESCRIPTION OF THE PREFERRED EMBODIMENTS:

Referring to the drawings there may be seen the representation of a rock crusher according to this invention. The rock crusher includes as its principal element rotor 10 which is surrounded by container 12. The rotor is mounted upon vertical shaft 14 which is connected by bearings 17 to framework 16 and container 12. The shaft is driven by one or more motors 18 by belt drive 20.

Feeder 22 is attached to top 24 of the container 12. The feeder as illustrated is in the form of a funnel 26. The lower part of the funnel or chute or tube 28 extends to below top 40 of the rotor 10.

Therefore in basic operation, rocks are fed into the feeder 22 into the spinning rotor 10 to be slung from ports 30 in the rotor to impact anvil 32. The anvil may take many different forms, in some instances it is a massive piece of metal that the rocks impact against. However, preferably the anvil is a pack of rocks 32 formed in the container 12.

Lower shelf 34 is built onto the container. The shelf is at a level somewhat below the bottom of the rotor. The rocks from the rotor will build up on the shelf and therefore this will form the rock pack 32 wherein other rocks will be impacted and crushed. In certain instances as will be described later, a top shelf 36 which will cause the anvil 32 to have the correct shape and form for most efficient operation. The crushed rocks will fall between the lower shelf 34 and the framework supporting the bearings 17.

Those having skill in the art will recognize that the description to this point is old, well-known and commercially on the market.

Balancer base plate 38 is attached to rotor top 40. A tore or hollow ring 42 is mounted on top of the base plate 40 and thus the rotor 10. The ring will have a square cross section about 4" wide and 4" in height. Ring top 44 includes a 4" diameter opening 46 with plug 48 therein. By means of the opening 46 dense fluid may be inserted into the ring 42.

"Fluid" is used in its broadest sense, meaning a substance (as a liquid) tending to flow to the outline of its container. Both mercury and metal spherical balls 50 and many other substances would be included in this definition of fluid.

It has been found that about sixty pounds of steel balls works well. The balls will be subject to considerable wear and therefore they should be of a wear resistant ball, for example, made from chrome steel alloy. It has also been found that dividing the balls so that they are about twenty pounds of balls or ¾" in diameter, twenty pounds or ½" in diameter, and twenty pounds or ⅜" in diameter works with some rocks. After the balls have been loaded into the tore 42, it is filled with oil 52. For convenience it is only necessary to fill the space about 90% full of the oil. However, in most areas having all the balls 3½" diameter works better. As described above a total of 60 pounds of rocks are used. However, better performance is usually obtained with about 75% of the volume filled with oil.

The smaller balls (¾", ½", and ⅜") result in a smoother starting time which is the 15–20 seconds when the rotor is started and being accelerated to operation speed. However, after the rotor reaches operating speed the larger balls results in better balance.

It is necessary to have sufficient balls and weight within the ring 42 to sufficiently balance it. Although sixty pounds is desired normally more than about fifty pounds is necessary. Protection plate 56 is attached to an balancer base plate 38. The protection plate is attached to cylindrical wall 54 which is spaced about ½" outboard of the ring 42. The protection plate 56 will extend about 4" from the cylindrical wall 54 and there fore will be within an inch of the edge of the ring. It has been found that this is sufficient clearance to protect the ring from damage.

It will be noted that the tube or chute 28 extends into the rotor below the bottom of the balancer base plate 38.

Three vanes 58 are mounted in the rotor 10. These vanes are made from flat plate and extend from the rotor bottom disc 60 to the balancer base plate 38. The vanes are made from half inch steel plate. At inner edge 62 on the top each vane 58 has a nut 66 welded in place. The nut 66 receives and is threaded to bolt 64 pending through the ring protector plate. Thus the inside top edge of the vanes is anchored in place.

The direction of rotation is indicated upon the drawings by an arrow. The forward face of vane 58 is designated as forward or leading face 68. The opposite face of the vane is the trailing face 70. The leading face will be at an acute angle to the inside of the rotor 10 at the connection point. By acute angle it is meant that the leading face will be at an acute angle to a tangent to the circle defining the inside of the rotor. Likewise the trailing face 70 will form an obtuse angle to the inside of the rotor 10 at that point. If the line projected from the trailing face is projected as shown by the dashed line 72 in the drawings (FIG. 3 ) it would be about ten inches from the axis of the rotor. For one design of the rotor, the rotor will have an inside diameter of approximately thirty-six inches and therefore a radius of eighteen inches. Calculation will show that the acute angle will be approximately 70° and the obtuse angle approximately 110°.

Figure 3:
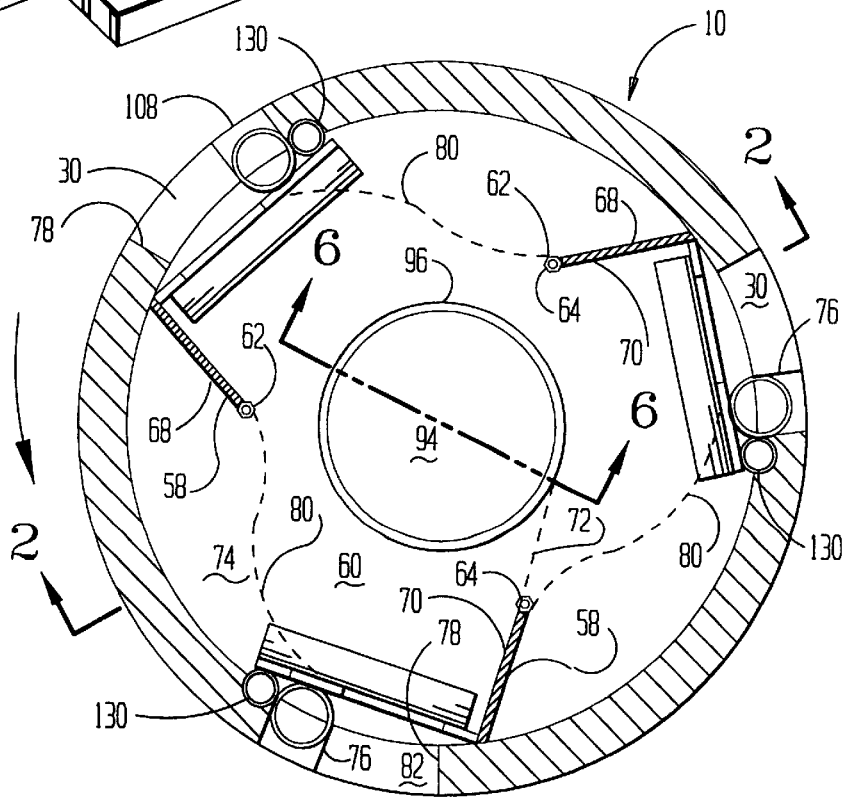
FIG. 3 is a cross-sectional view of the rotor according to this invention taken substantially on line 3—3 of FIG. 2.
Figure 8:
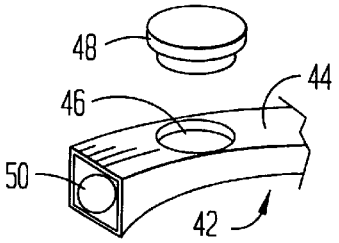
FIG. 8 is a detail of the balancing ring with the balancing balls therein.
Figure 2:
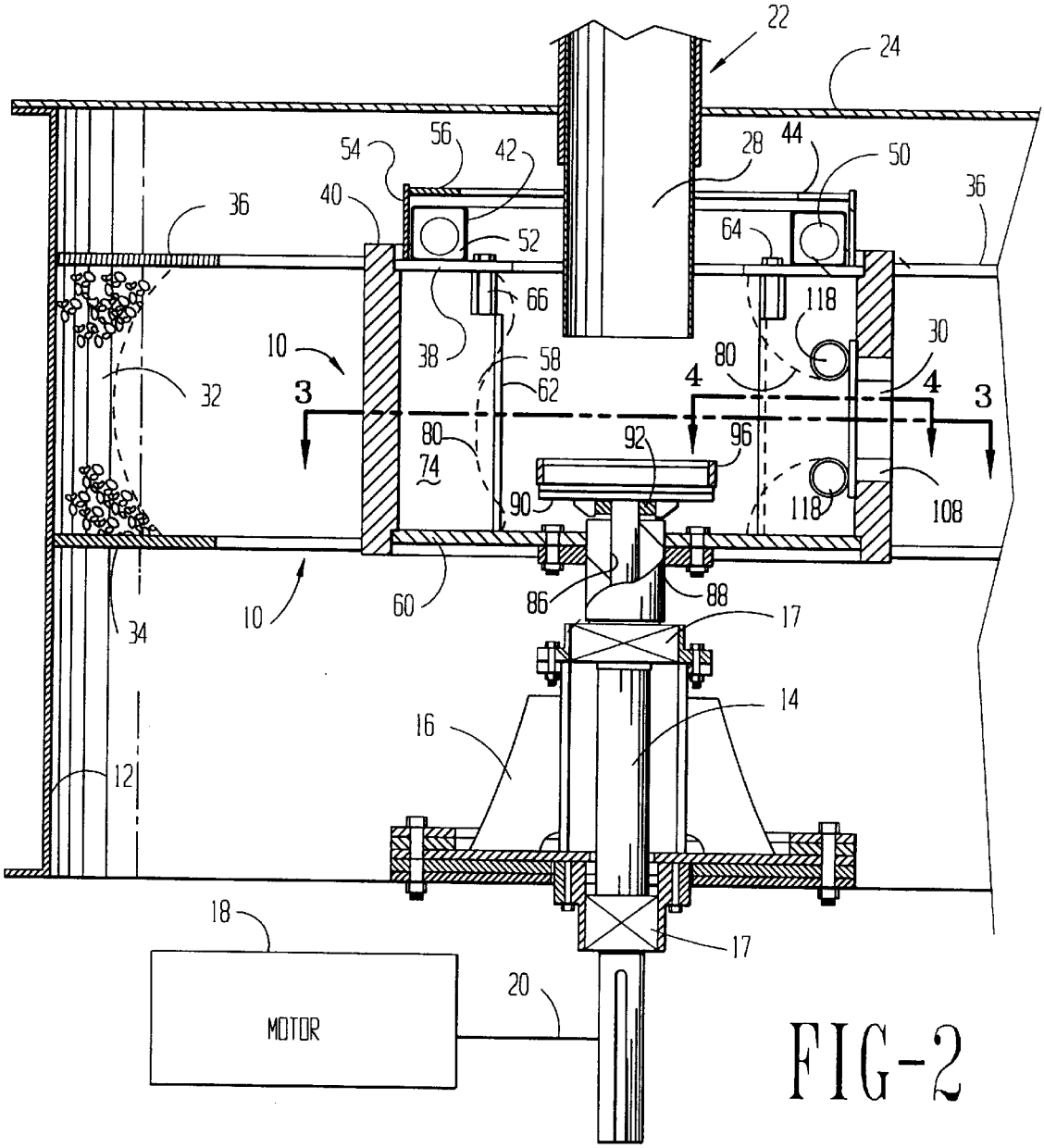
FIG. 2 is an axial sectional view of the principal working parts of rock crusher.
Figure 4:
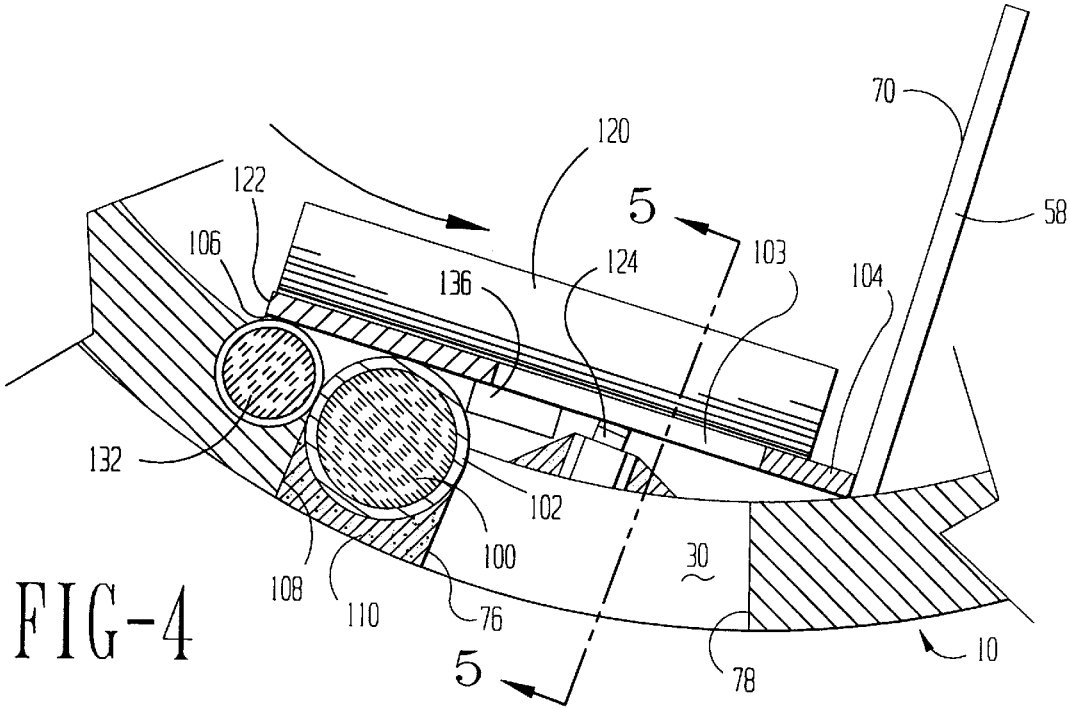
FIG. 4 is a sectional view across a port and door taken substantially along line 4—4 of FIG. 2 and line 4—4 of FIG. 5.
Figure 6:
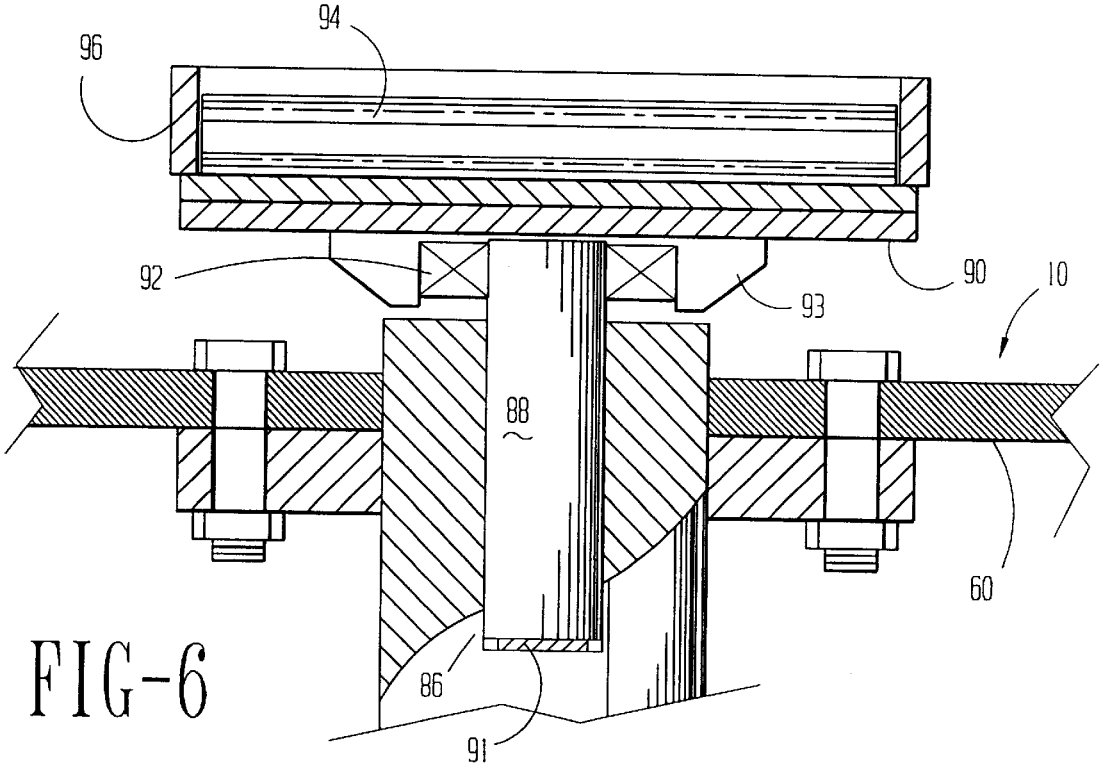
FIG. 6 is a axial sectional view of the free-wheeling table taken substantially along line 6—6 of FIG. 3.
Figure 7:
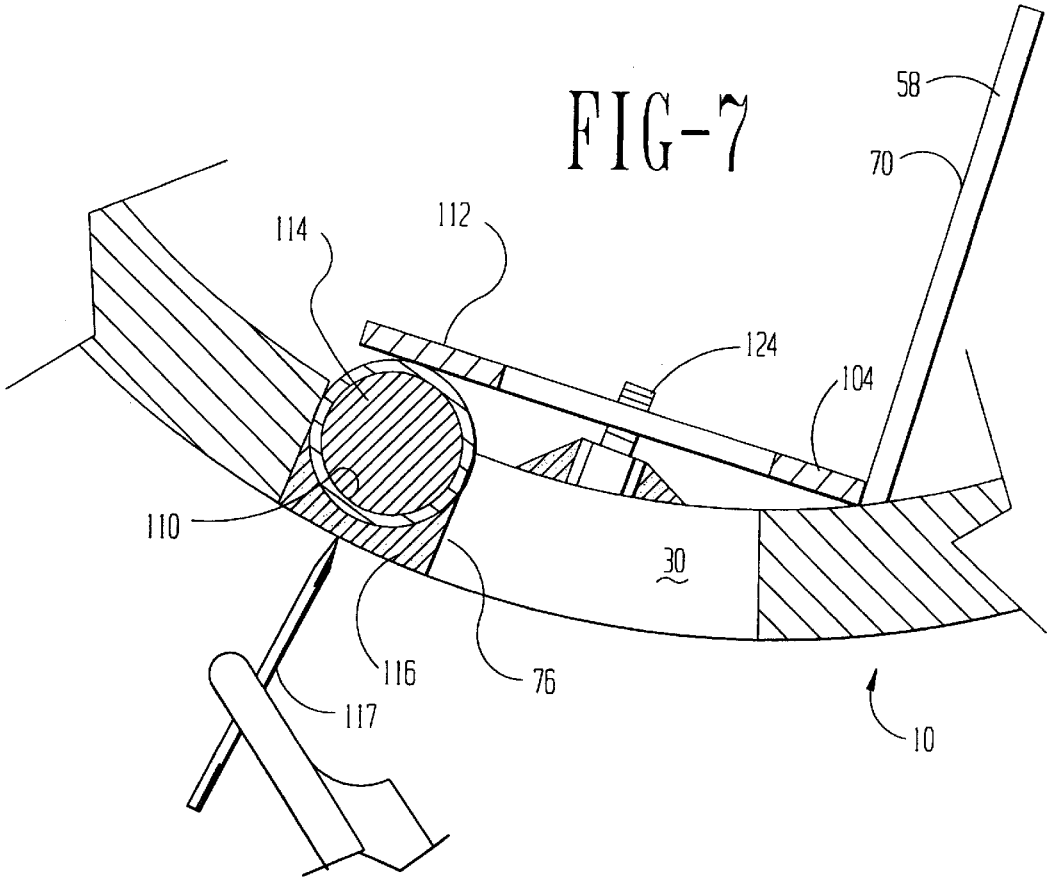
FIG. 7 is a sectional view similar to FIG. 4 showing the placement of the lip pin during manufacture.
Figure 5:
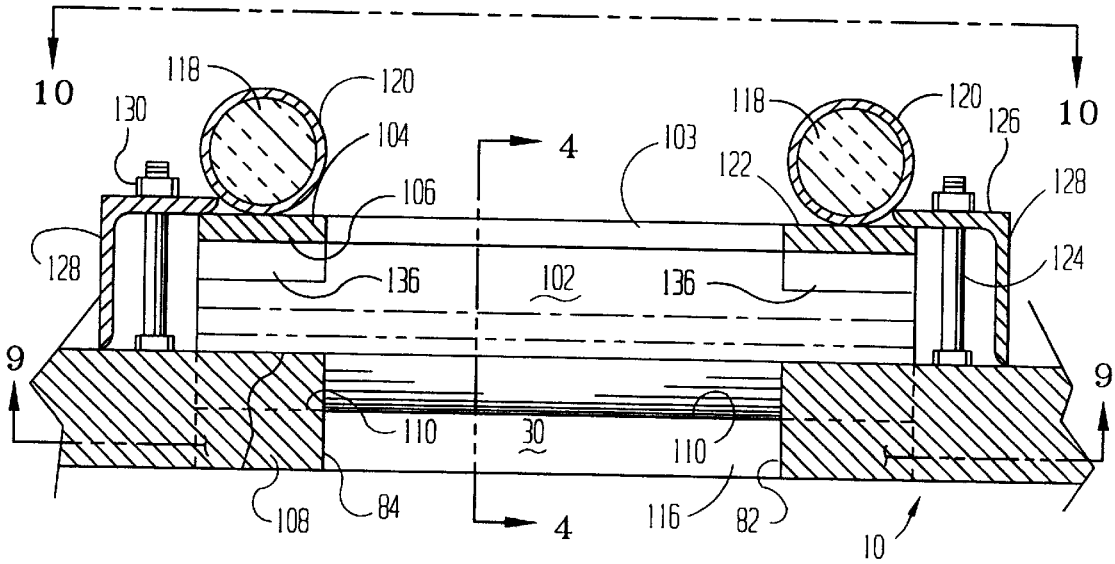
FIG. 5 is a sectional view of the door and port taken substantially along line 5—5 of FIG. 3 and line 5—5 of FIG. 4.
Figure 9:
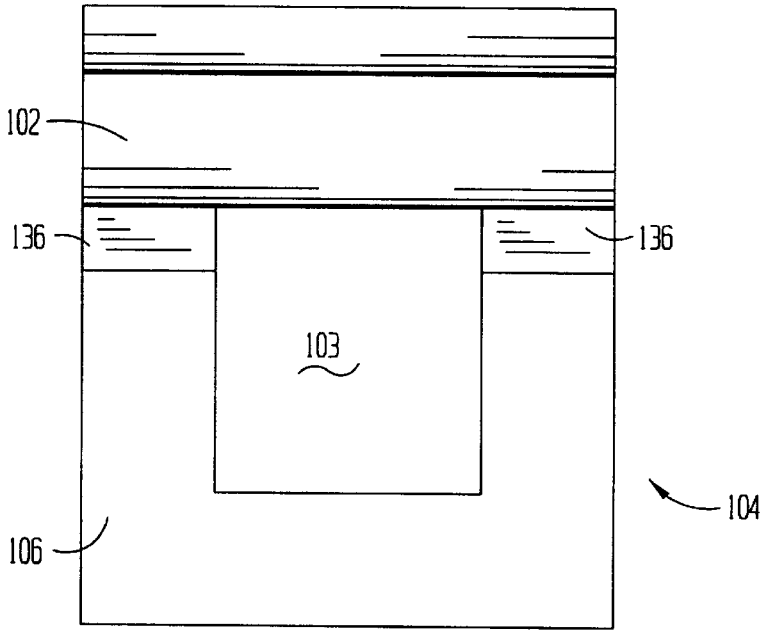
FIG. 9 is a detail of a door showing the outside face of the door which is adjacent to the rotor shell.
Figure 10:
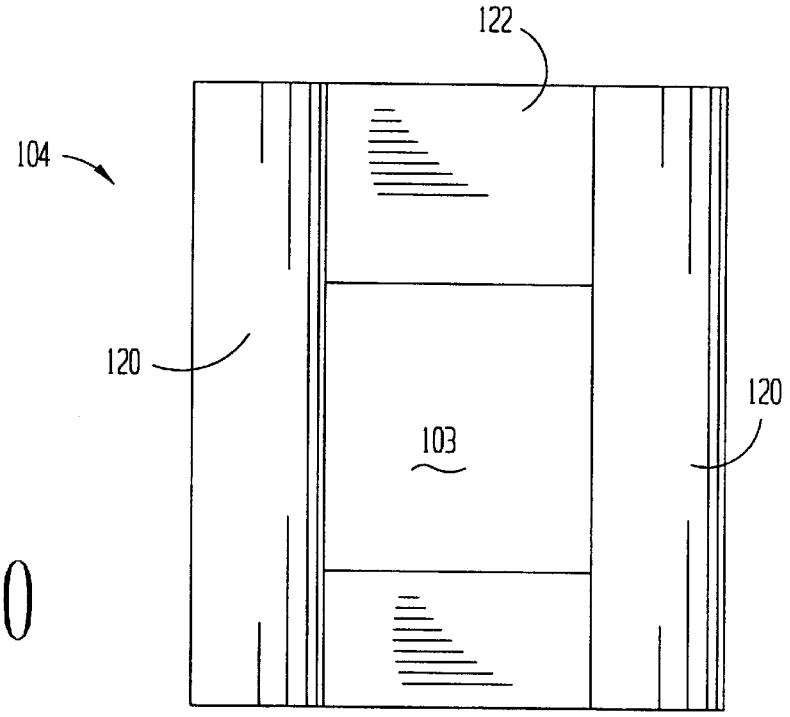
FIG. 10 is a view of the inside face of the door which is exposed to the interior of the rotor.

The height of the rotor will be about 24" and the height of the ports 30 will be about 6". The ports are located about 6" above the bottom plate of the rotor and about 8" from the bottom of the ring protection plate. Referring to FIG. 3 it may be seen that rock shield 74 will build up from the leading face 58 of the vane. This rock face will extend to trailing lip 76 of each port 30. The leading lip 78 of each of the ports 30 is spaced about 2" from the trailing face 70 of each vane 58.

As will be explained later the entering rocks will have a very low rotational velocity from the chute. Therefore incoming rocks will impact upon the rock shield 74. Therefore once the rock shield is established shortly after the beginning of the use of the rotor, the vanes will be protected from incoming rocks. The rocks will work by centrifugal force downward along the face 80 of the rock shield. Therefore after the initial installation, the rocks will impact and move along the rock shield 74 and not upon any of the structural parts of the rotor.

Likewise a similar rock shield will build up from the disc 60 of the rotor to bottom lip 82 of each port 30. Another rock shield will build from the bottom of the ring base plate 38 to the top lip 84 of the port 30. It is possible to establish these rock shields because of the vast reduction of the vibrations obtained by the self-balancing action of the balls 50 within the balancing ring 42.

The rotor 10 is attached by the disc 60 to the top of the vertical shaft 14. The top of the vertical shaft 14 has an axial bore 86. Table pin 88 telescopes within the axial bore 86. Table disc 90 is mounted around bearing 92. Bearing 92 fits on the top of the pin 88. Four projecting lugs 93 depend from the bottom of the table disc around the bearing holding it in position. The table does not rotate with the shaft 14. Although the table may have some rotation, its rotational speed will be much less than the rotational speed of shaft 14.

The diameter of the table disc 90 is less than half of the inside diameter of the rotor. The tube 28, the shaft 14, and the table are co-axial. The tube 28 is directly over the center of the table. When the rocks are fed into the rotor they are not fed onto a structural member which is spinning at the speed of the rotor. Therefore the rocks are discharged from the table at a rotational speed much lower than that of the rotor. Therefore the rocks impact the rock shield 74 rather than a structural member within the rotor. Stated otherwise, the slow moving rocks are struck by the rapidly moving rock shield.

To prevent abrasion across the top face of the table, a tungsten carbide disc 94 is mounted upon the top of the table disc 90. Steel ring 96 is fashioned around the table disc and the carbide disc about 1½" thick is cemented or adhered within the ring and onto the table disc. It is adhered in place by epoxy.

It is necessary to protect the edges of the port 30. The three ports 30 are all protected in the same way therefore the description will be the same for any one of the three.

The major abrasive action is at the trailing lip 76 protected by lip pin 100. In fact, so slight is the abrasion at the leading lip 78 no measures are taken to protect the leading lip.

The pin 100 is made of tungsten carbide. In one embodiment the pin is 3" in diameter and 12" long. Other embodiments of the pin might be 1½" in diameter and 12" long and another might be 2" in diameter and 12" long. Basically, it has been found that the 1½" diameter will have approximately a two month life, the 2" diameter will have approximately a four months life, and the 3" diameter will have approximately a six to eight months life. Inasmuch as tungsten carbide is normally sold by the pound, it may be seen that the tungsten carbide cost would be least using the 1½" diameter pins. However, the replacement would be shorter. Therefore, the diameter of the pins would be based upon as to whether money was attempted to be saved by having the cost of the pins reduced or to have the cost of replacement reduced.

In each case the pin would be encased in a pipe is either 3½ or 3⅜ according to the preference of the user and the size that the nest or the seat made by a brass pin as described later. The tungsten carbide pin 100 is telescoped within steel tube or pipe 102 which has an outside diameter of 3⅜" and which is 12" in length. The inside diameter of the pipe 102 is slightly larger than 3" so that the tungsten carbide pin can be placed inside. The tungsten carbide pin 100 is adhered in place by epoxy.

The pin 100 in the pipe 102 is placed upon a plate or door 104. The door is made of ½" steel plate and has an outside dimension of 12"×14". Adjacent to the pipe 102 is an square opening 6"×6" which is positioned to align or register with the port 30 which is also 6"×6". The 12" edge of the plate will be parallel to the vertical shaft 14. The 14" dimension of the door will be parallel to the top lip 84 and bottom lip 82 of the port. A slot 108 is cut through the rotor 10 to receive the pipe 102. To accommodate the pipe it is necessary that the slot be 12" long therefore it would project 3" above and 3" below the port 30. A nest or seat 110 is fashioned in the slot 108. To fashion the seat a dummy or pattern is made by attaching brass pin 114 3⅜" diameter to pattern plate 112. The plate 112 is positioned over the port 30 the same as the door in use. With the pattern plate 112 and the brass pin 114 in place, weld metal 116 is placed by a welding rod onto the rotor in the slot to fill the space between the edges of the slot and the brass pin. The weld metal will not adhere to the brass and therefore after a seat is formed by the weld metal 116, the brass pin may be removed leaving a seat fashioned to fit the pipe 102 when it is installed. Therefore it may be seen that the pipe 102 is supported by the seat 110 in the rotor 10 and does not depend entirely upon the door for its support.

As discussed before, the pin 100 is normally the first pin which fails. With the balancing ring with the mass of balls therein prevents a out of balance vibration when the pin fails. Therefore, the rotor is in jeopardy of having the rotor shell eroded when the pin 100 fails. To prevent this a safety pin 132 is placed parallel to the safety pin on the trailing side of the safety pin. The safety pin 132 will normally be 1½" in diameter. The safety pin is telescoped within a 1⅞" pipe. This pipe 134 is welded to the outside face 106 of the door 104.

The safety pin 132 not only provides protection for the rotor when the lip pin 100 fails, but also holds the pin 100 in its pipe 102 in place. Additional holding blocks 136 are welded to the outside face 106 of the holding door. As may be seen they are attached as by welding to the upper and lower portions of the door 104.

Therefore, it may be seen that the pin 100 in its pipe 102 is held in place by the seat 110, the holding blocks 136, the safety pin pipe 134 as well as the outside face 106 of the door 104. When the pin 100 fails it is not necessary to replace the door 104 with the safety pin 132 and horizontal pins 118 welded to the door. All that is necessary is to remove the door and fragments of the pin 100, insert a new pin 100, and reclamp the door back over it with the holding blocks and safety pin securely holding the new pin 100 within its seat 110.

Two horizontal pins 118 are attached to inside face 122 of the door 104 so that when the door is positioned they are along the bottom and top lips 82 and 84. The horizontal tungsten carbide pins 118 are mounted similar to the pin 100. That is to say that each of them are telescoped within a pipe 120 which has an outside diameter of 1⅞" and an inside diameter of about 1½" to receive the 1½" horizontal pin which is held in place by epoxy. Then one pipe 120 is welded so that it will be along the top lip 84 and the other so it will be along the bottom lip 82. The pipes 120 are welded to the inside face 122 of the door 104.

As previously stated the width of the door will be 14". The 6" square opening 103 will be spaced 2" from the edge away from the pin 100. This edge of the door butts the trailing face 70 of the vane 58. The port will also have its leading lip 78 2" inches from the trailing face 70 of the vane 58.

Therefore it may be seen that the top and bottom lips and the trailing lip of the port are protected by the tungsten carbide pins. There will be a certain abrasion of the tungsten carbide pins but they are protected from breakage by their support within the pipes in which they are encased. The pipes themselves are protected by being welded to the door and also the pin 100 and its pipe 102 is supported by its seat 110 made of the weld metal 116.

A bolt 124 is welded onto the inside face of the rotor 10 above and below the door 104. The bolts 124 are threaded through an opening in top flange 126 of clips 128. Nut 130 upon each bolt clamps the top flange 126 of the clip 128 against the inside face 122 of the door. The rock packs extending above and below the top and bottom lips of the ports will cover and protect the bolts and nuts from abrasion and impact of the uncrushed rocks within the rotor.

It will be understood that in a fraction of an hour after the pins are installed within their pipes that the pipes will be abraded away on the surfaces that the rocks transverse. After that portion of the pipe is gone the tungsten carbide pin within them is exposed to the movement of the rocks across the pin. The tungsten carbide pins are expected to have a life measured in months rather than minutes.

As discussed above, the life of the door and the tungsten carbide pins on it are measured in months. Normally the first pin to fail will be the lip pin. As discussed in the diameter of the pins, the life of this pin may be anywhere from two to eight months. It will be noted that with the present design that when the lip pin fails and no other repair is needed, that the lip pin can be replaced very quickly. Specifically, all that is necessary is to remove the door or holding frame and remove the old lip pin. Then place a new lip pin between the holding frame and the seat. Then attaching the holding frame to the rotor completes the replacement. Therefore, since the lip pin is not attached to the holding frame, there is no need to replace the entire holding frame. When it is necessary to replace the door assembly with the tungsten carbide pins thereon it takes only a short while to remove the three old doors and replace them with three new or rejuvenated doors.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. In a rock crusher having a) a vertical rotatable shaft having a top, b) a motor mechanically connected to the shaft for rotating the shaft, c) a rotor connected to the top of the shaft, d) a feeder located above the shaft adapted to feed rock into the rotor, e) at least one rock exit from the rotor, and f) an anvil horizontally surrounding and enclosing the rotor, g) so arranged and constructed that rocks fed into the rotor when rotating will be slung from the exit against the anvil;

the improved structure for reducing maintenance by reducing vibration of the rotor comprising:

h) a circular hollow ring having a height of 4 inches and width of 4 inches along the rotor attached to the rotor, and i) approximately sixty pounds of steel balls having a diameter of approximately 3½ inches in said ring.

2. The structure as defined in claim 1 further comprising: oil in the ring having a level approximately ¾ of the height of the ring when at rest.

3. The structure as defined in claim 1 further comprising: said balls are chrome steel.

4. The structure as defined in claim 1 further comprising:

j) oil in the ring having a level of approximately 3" in height of the ring when at rest, and k) said balls are chrome steel balls.

5. In a rock crusher having a) a vertical rotatable shaft having a top, b) a motor mechanically connected to the shaft for rotating the shaft, c) a rotor connected to the top of the shaft, d) a feeder located above the shaft adapted to feed rock into the rotor, e) ports in the rotor, and f) each port having a leading lip and trailing lip, and g) an anvil horizontally surrounding and enclosing the rotor, h) so arranged and constructed that rocks fed into the rotor when rotating will be slung from the ports against the anvil;

the improved structure for reducing maintenance by reducing abrasion around ports comprising:

i) an abrasion resistant lip pin mounted on each of the trailing lips, j) a safety pin mounted adjacent and parallel each lip pin on the trailing side of the lip pin, and k) each of said pins parallel to said shaft.

6. The structure as defined in claim 5 further comprising: each safety pin having a diameter approximately 1½".

7. The structure as defined in claim 5 further comprising: each lip pin has a diameter which is as large as the safety pin.

8. The structure as defined in claim 5 further comprising:

l) said pins constructed of a metallic carbide compound, and m) each pin telescoped and adhered within a metal pipe.

9. The structure as defined in claim 8 further comprising: said pins constructed of tungsten carbide.

10. The structure as defined in claim 5 further comprising:

l) a top pin along a top of each of the ports, m) a bottom pin along a bottom of each of the ports, n) each of said top, bottom, lip, and safety pins telescoped and adhered within a pipe.

11. The structure as defined in claim 10 further comprising:

o) a mounting plate for each port, p) said safety, top and bottom pins for a port attached to each mounting plate, q) said mounting plate having a rectangular opening therein which matches the port, and r) each of said mounting plates attached to the inside of the rotor over a corresponding port.

12. The structure as defined in claim 11 further comprising:

s) said safety, top, and bottom pins attached to each mounting plate by welding the metal pipe to said mounting plate, t) said lip pin resting in a seat formed in said rotor, and u) mounting blocks on said mounting plate holding said lip pin in said seat.

13. The structure as defined in claim 5 further comprising:

l) a top pin along the top of each port, m) a bottom pin along the bottom of each port, n) a mounting plate for each port, o) said safety, top, and bottom pins for a port attached to each mounting plate, p) said mounting plate having a rectangular opening therein which matches the port, and q) each of said mounting plates attached to the inside of the rotor over a corresponding port.

14. The structure as defined in claim 13 further comprising:

r) said lip pin resting in a seat formed in said rotor, and s) mounting blocks on said mounting plate holding said lip pin in said seat.

15. In a rock crusher having a) a vertical rotatable shaft having a top, b) a motor mechanically connected to the shaft for rotating the shaft, c) a rotor connected to the top of the shaft, d) a feeder located above the shaft adapted to feed rock into the rotor, e) ports in the rotor, and f) each port having a leading lop and trailing lip, and g) an anvil horizontally surrounding and enclosing the rotor, h) so arranged and constructed that rocks fed into the rotor when rotating will be slung from the ports against the anvil;

the improved structure for reducing maintenance by reducing abrasion around ports comprising:

i) a top pin along the top of each port, j) a bottom pin along the bottom of each port, k) a mounting plate for each port l) said top and bottom pins for a port attached to each mounting plate, m) said mounting plate having a rectangular opening therein which matches the port, n) each of said mounting plates attached to the inside of the rotor over a corresponding port, o) a lip pin resting in a seat formed in said rotor, and p) mounting blocks on said mounting plate holding said lip pin in said seat.

* * * * *